US009211467B2

(12) United States Patent
McNamee

(10) Patent No.: US 9,211,467 B2
(45) Date of Patent: Dec. 15, 2015

(54) GLOVE WITH STRENGTHENING INSERTS

(75) Inventor: Mark McNamee, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 611 days.

(21) Appl. No.: 13/007,329

(22) Filed: Jan. 14, 2011

(65) Prior Publication Data

US 2012/0180190 A1 Jul. 19, 2012

(51) Int. Cl.
*A63B 71/14* (2006.01)
*A41D 19/00* (2006.01)

(52) U.S. Cl.
CPC ..... *A63B 71/143* (2013.01); *A41D 19/0006* (2013.01)

(58) Field of Classification Search
CPC .... A63B 71/143; A63B 71/14; A63B 71/141; A41D 19/006
USPC ..... 2/19–21, 161.1, 164, 167
See application file for complete search history.

(56) References Cited

U.S. PATENT DOCUMENTS

| | | | | |
|---|---|---|---|---|
| 3,930,921 | A | 1/1976 | Connett | |
| 4,366,579 | A * | 1/1983 | Noguchi | 2/19 |
| 5,694,642 | A | 12/1997 | Rector | |
| 6,430,745 | B2 | 8/2002 | Murai | |
| 6,599,629 | B2 | 7/2003 | Mendoza | |
| 6,681,402 | B1 * | 1/2004 | Bevier et al. | 2/19 |
| 6,880,269 | B2 | 4/2005 | Falone | |
| 7,179,538 | B2 | 2/2007 | Gauthier | |
| 7,437,773 | B2 | 10/2008 | Aoki | |
| 7,526,880 | B2 | 5/2009 | Polcek | |
| 7,574,749 | B2 * | 8/2009 | Kogawa et al. | 2/19 |
| 7,841,017 | B2 * | 11/2010 | Aoki | 2/19 |
| 2005/0268367 | A1 * | 12/2005 | Kogawa et al. | 2/19 |
| 2006/0137067 | A1 * | 6/2006 | Wu | 2/19 |
| 2006/0195967 | A1 * | 9/2006 | Kohler | 2/161.1 |
| 2006/0218689 | A1 * | 10/2006 | Brown | 2/19 |
| 2007/0220650 | A1 * | 9/2007 | Aoki et al. | 2/19 |
| 2009/0126074 | A1 * | 5/2009 | Mattesky | 2/161.8 |
| 2010/0050319 | A1 | 3/2010 | Fujihana | |

* cited by examiner

*Primary Examiner* — Shaun R Hurley
*Assistant Examiner* — Andrew W Sutton
(74) *Attorney, Agent, or Firm* — Shook, Hardy & Bacon L.L.P.

(57) ABSTRACT

An athletic glove capable of receiving a human hand is provided. The glove comprises an exterior glove shell having a palm side portion and a back portion and an interior glove liner connected together to form index, middle, ring, and pinky finger sheaths and a thumb sheath. A glove webbing is connected to and extends between the thumb sheath and the index finger sheath. A middle layer is located between the exterior shell and the interior liner. One or more low-elasticity strengthening inserts are affixed to the palm-side portion of the exterior glove shell. The inserts maintain the integrity of the exterior glove shell after repeated use of the glove by limiting the amount the exterior glove shell stretches.

17 Claims, 9 Drawing Sheets

GLOVE WITH STRENGTHENING INSERTS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to athletic gloves. More particularly, the present invention relates to athletic gloves with one or more integrity-enhancing inserts.

BACKGROUND

Athletic gloves of various types are widely used in sports to improve performance. In sports such as baseball and softball, players typically wear a glove on the non-throwing hand for catching fly balls, throws, and line drives and for fielding ground balls. Gloves are typically made of a durable exterior shell such as leather, an interior liner, and one or more middle layers. Middle layers are conventionally made of felt or leather and provide cushioning, support, and rigidity to the glove.

Leather gloves are conventionally shaped to a player's preference during the "breaking in" process in which softening substances are applied to the leather. The glove may then be bound or otherwise held in a desired position. After a certain amount of time has elapsed, the glove will dry and take on the desired shape. As the name implies, breaking in a glove adversely affects the structural integrity of the glove. The integrity of the glove, and especially the exterior shell, is also adversely affected by repeated opening and closing of the glove and impacts from caught or fielded balls during normal use. The forces applied to the glove during the breaking-in process or during normal use reduce the structural integrity of the glove by, among other things, causing the layers of the glove to stretch. Continued application of forces that cause the glove layers to stretch and break down eventually requires the glove to be replaced.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An athletic glove capable of receiving a human hand is provided. The glove comprises an exterior glove shell having a palm-side portion and a back portion. The palm-side portion has a palm portion, four finger portions, and a thumb portion. The exterior glove shell and an interior glove liner are connected together to form index, middle, ring, and pinky finger sheaths, a thumb sheath, and an opening capable of receiving a human hand. The opening is located opposite the four finger sheaths and corresponds approximately to the wrist of a user when the glove is worn by the user with fingers of the user extending within the four finger sheaths and the thumb of the user extending within the thumb sheath. A glove webbing is connected to and extends between the thumb sheath and the index finger sheath. A middle layer is located between the exterior glove shell and the interior glove liner. The middle layer provides cushioning and rigidity to the glove. A low-elasticity strengthening insert is affixed to the interior surface of the palm-side portion of the exterior glove shell. The insert has an elasticity lower than the elasticity of the exterior glove shell, and the insert maintains the integrity of the exterior glove shell after repeated use of the glove by limiting the amount the exterior glove shell stretches.

BRIEF DESCRIPTION OF THE DRAWINGS

The present invention is described in detail below with reference to the attached drawing figures, wherein.

DETAILED DESCRIPTION

In conventional gloves used in baseball and softball, the glove layers, especially the exterior glove shell, often break down and lose their structural integrity over time. Structural integrity can be adversely affected by, among other things, stretching the glove layers. The present invention provides athletic gloves with low-elasticity strengthening inserts that significantly reduce the amount that the exterior glove shell stretches during normal use as compared to conventional gloves. Examples of the present invention are illustrated in FIGS. 1-30.

Figure 1:
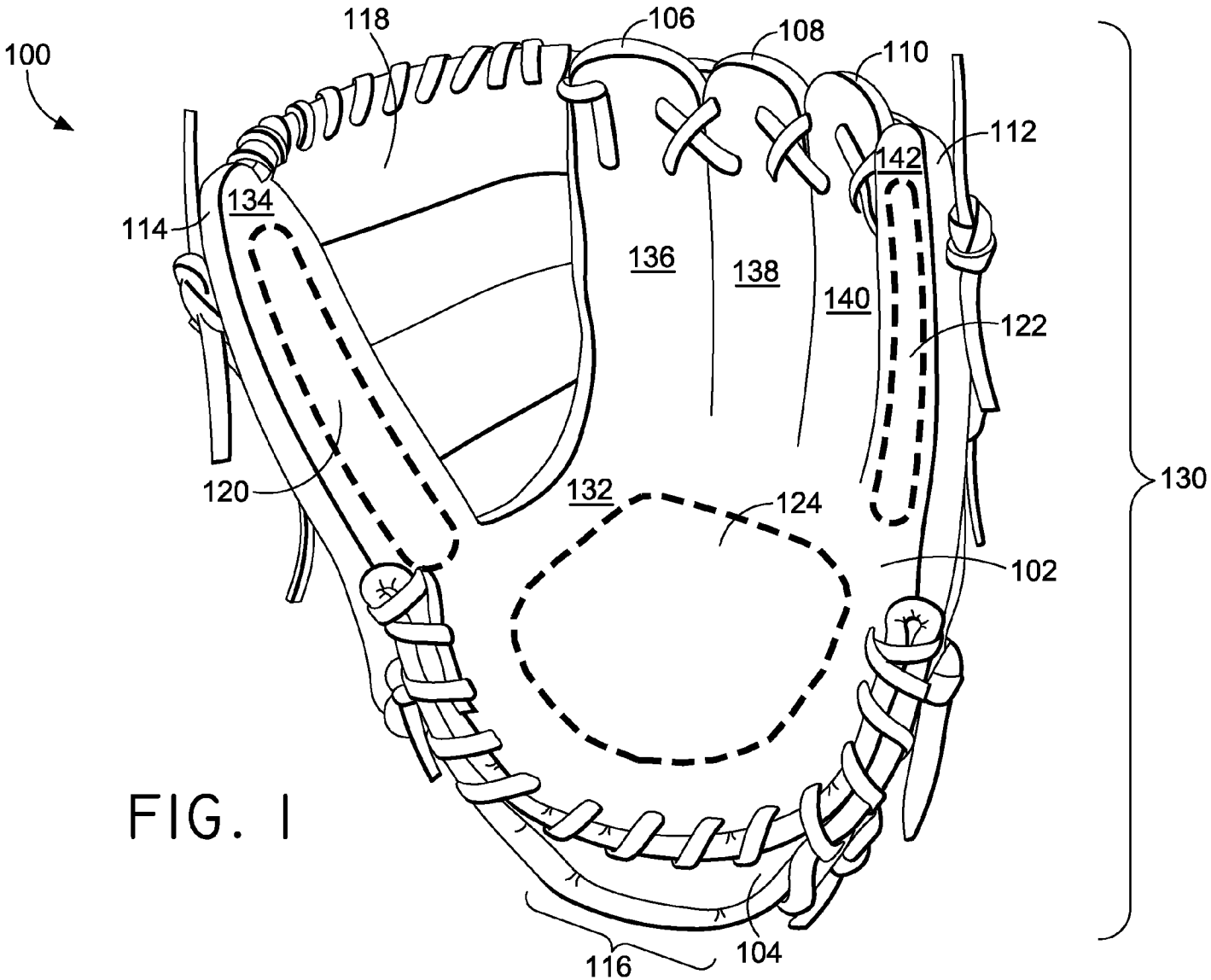
FIG. 1 is a perspective view of an exemplary athletic glove with three strengthening inserts affixed to the interior surface of the palm-side portion of the exterior glove shell in accordance with an example of the present invention.

FIG. 1 illustrates an athletic glove 100. Glove 100 comprises exterior glove shell 102. Exterior glove shell 102 is made of a durable material such as leather or synthetic leather. Interior glove liner 104 is substantially inside exterior glove shell 102 and is connected to exterior glove shell 102 to form index finger sheath 106, middle finger sheath 108, ring finger sheath 110, pinky finger sheath 112, thumb sheath 114, and opening 116. Opening 116 is capable of receiving a human hand and is located opposite finger sheaths 106, 108, 110, and 112.

Glove webbing 118 connects to and extends between index finger sheath 106 and thumb sheath 114. Glove webbing 118 may comprise one or more pieces of material connected to be substantially solid, woven, or otherwise interlocked or overlaid. Glove webbing 118 creates a "pocket" in glove 100 that is used to catch, field, and or hold a ball.

Glove 100 is designed to receive a left hand. Gloves designed to receive a right hand are also envisioned and within the scope of the present invention. For simplicity, only a glove designed to receive a left hand is shown in the drawings.

In some examples, interior glove liner 104 is made of leather or synthetic leather that is thinner than exterior glove shell 102. Interior glove liner 104 may be formed from multiple pieces of material and may comprise a substantial portion or all of the interior surface of glove 100. The portion of finger sheaths 106, 108, 110, and 112 and thumb sheath 114 contacted by a user's fingers and thumb when the glove is worn may be part of interior glove liner 104. Interior glove liner 104 and exterior glove shell 102 may connect along opening 116, among other places.

Glove 100 has one or more middle layers (not shown in FIG. 1) between exterior glove shell 102 and interior glove liner 104. Middle layers often provide cushioning, support, and rigidity to glove 100. In some examples, middle layers are made of felt or leather. If a particular thickness is desired to provide a certain amount of rigidity or cushioning, additional or thicker middle layers can be used to provide the desired thickness. In some examples, exterior glove shell 102 is thicker in the palm area to provide additional cushioning.

Exterior glove shell 102 comprises a palm-side portion 130 and a back portion (not shown in FIG. 1). Palm-side portion 130 comprises palm portion 132, thumb portion 134, and finger portions 136, 138, 140, and 142. Low-elasticity strengthening inserts 120, 122, and 124 are each affixed to the interior surface of palm-side portion 130 (not shown in FIG. 1). Insert 120 is affixed to thumb portion 134, insert 122 is affixed to finger portion 142, and insert 124 is affixed to palm portion 132. Strengthening inserts 120, 122, and 124 maintain the integrity of exterior glove shell 102 after repeated use of the glove by limiting the amount exterior glove shell 102 stretches. Maintaining the integrity of exterior glove shell 102 reduces a negative impact on performance caused by portions of the glove collapsing together more easily than desired or not collapsing in a desired way.

As used in this application, "low-elasticity" refers to an elasticity lower than the elasticity of the material to which the low-elasticity insert is affixed or attached. Thus, with reference to glove 100, because low-elasticity strengthening inserts 120, 122, and 124 are affixed to the interior surface of palm-side portion 130 of exterior glove shell 102, the elasticity of inserts 120, 122, and 124 is lower than the elasticity of exterior glove shell 102. The low elasticity of inserts 120, 122, and 124 reduces the effective elasticity of exterior glove shell 102 where the inserts are affixed, thus reducing the amount exterior glove shell 102 can stretch.

In some examples, a glove has at least one strengthening insert. In other examples, a glove has at least two strengthening inserts. Low-elasticity strengthening inserts 120, 122, and 124 may be made of any pliable low-elasticity material that maintains the integrity of the portions of exterior glove shell 102 to which they are attached. In one example, the material is permeable to air and water. In some examples, inserts 120, 122, and 124 are made of a pliable, non-woven polyester material. In one particular example, inserts 120, 122, and 124 are made of non-woven polyester materials made by Texon International Group, Ltd.

Inserts 120, 122, and 124 may be affixed to the interior surface of palm-side portion 130 of exterior glove shell 102 by sewing, laminating, or other methods. In some examples, the strengthening inserts are shaped and affixed to the interior surface of palm-side portion 130 of exterior glove shell 102 in locations selected to maintain the integrity of the glove in the selected locations so that creasing of the glove in the selected locations is minimized. The selected locations of the strengthening inserts may also be selected to cause the glove to crease in a desired location other than the selected locations.

For example, if it is desired that a glove not crease across the middle of the palm from between the thumb sheath and finger sheaths diagonally across the glove, then a low-elasticity strengthening insert can be affixed to palm portion 132 of palm-side portion 130 of exterior glove shell 102. The insert will prevent exterior glove shell 102 from stretching, losing integrity over time, and allowing a crease to develop. Similarly, if a crease is desired in a particular area, strengthening inserts can be affixed to exterior glove shell 102 on either side of the desired crease. This prevents a crease from developing where the inserts are affixed but allows a crease to develop in the desired location.

In some examples, glove 100 is a mitt such as a baseball or softball catcher's or first-baseman's mitt. Gloves typically have finger sheaths such as sheaths 106, 108, 110, and 112 that are clearly visible as distinct finger sheaths and are connected together at one or a few points. For example, sheaths 106, 108, 110, and 112 are stitched together near the end of the sheaths. Glove finger sheaths may not be connected together along the entire length of the finger sheaths. Although connected near the ends, finger sheaths 106, 108, 110, and 112, for example, are not connected together along the majority of the length of each finger sheath.

The finger sheaths of mitts, in contrast, are typically not clearly visible as distinct finger sheaths when the palm-side portion of the exterior glove shell is primarily viewed. The finger portions of the palm-side portion of the exterior glove shell of a mitt are typically connected together to form a continuous piece of material. If, for example, glove 100 were a first-baseman's mitt, finger portions 136, 138, 140, and 142 of palm-side portion 130 of exterior glove shell 102 would be one continuous piece. Finger sheaths 106, 108, 110, and 112 would still be present although not distinctly visible as finger sheaths when palm-side portion 130 is primarily viewed. Finger sheaths 106, 108, 110, and 112 could be visible as distinct sheaths when the back portion of exterior glove shell 102 is viewed.

Figure 2:
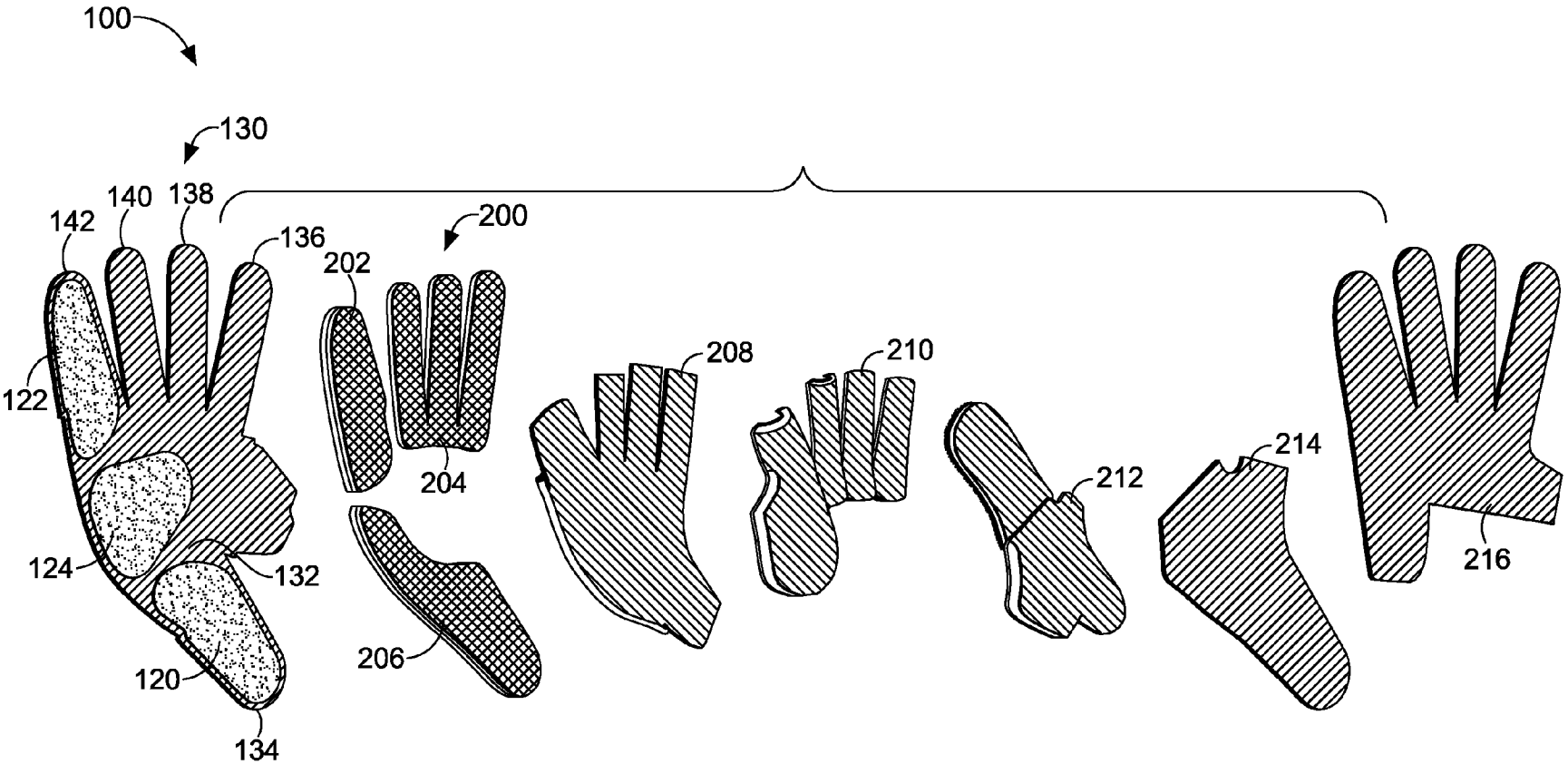
FIG. 2 is an exploded perspective view of an exemplary athletic glove with six strengthening inserts affixed to the interior surface of the palm-side portion of the exterior glove shell in accordance with an example of the present invention.

FIG. 2 illustrates an exploded perspective view of glove 100 illustrating exemplary layers that are connected together to form glove 100. Affixed to the interior surface of palm-side portion 130 of exterior glove shell 102 are low-elasticity strengthening inserts 120, 122, and 124. Throughout this application, inserts are shown and described as attached to the interior surface of palm-side portion 130. The interior surface of palm-side portion 130 is the surface closer to the hand of a user when the glove is worn and is not typically visible when the glove is used as intended. It is also contemplated that inserts can be attached to the exterior surface of palm-side portion 130 such that the inserts are visible while the glove is worn. In some examples, palm-side portion 130 comprises multiple layers, and inserts are embedded between the layers. In other examples, inserts are affixed to at least one middle layer to prevent the middle layer from stretching and losing integrity. In still further examples, inserts may be affixed to the back portion of exterior glove shell 102.

Middle layer 200 comprises three pieces—pinky middle layer portion 202, finger middle layer portion 204, and thumb middle layer portion 206. In other examples, middle layer 200 is one continuous piece of material with an extent substantially similar to the extent of palm-side portion 130 of exterior glove shell 102. Finger middle layer portion 204 provides cushioning and rigidity to three finger sheaths of glove 100. In some examples, finger middle layer portion 204 is broken into three pieces—one for each corresponding finger sheath. As shown in FIG. 2, pinky middle layer portion 202, finger middle layer portion 204, and thumb middle layer portion 206 provide rigidity to glove 100 in places where a user's fingers do not reach. For example, thumb middle layer portion 206 is shaped to lay alongside and extend beyond a received thumb in order to provide rigidity to glove 100 where the received thumb does not reach. In this way, middle layer 200 "fills up" the glove in places where a received hand does not reach.

Glove 100 can include a number of middle layers comprising a number of pieces. In some examples, middle layers are only present in particular parts of the glove (e.g., only in the palm, thumb, and fingertips of the glove). In other examples, additional middle layers are present in particular parts of the glove or throughout the glove to provide additional cushioning and rigidity.

As shown in FIG. 2, each piece of middle layer 200 includes multiple layers. In some examples, multiple middle layers are used to attain a desired thickness. Interior glove liner sections 208, 210, and 212 are connected together to form the interior glove liner. The interior glove liner is the portion of glove 100 with which a user's hand primarily comes into contact when glove 100 is worn properly. Back portion sections 214 and 216 form the back portion of exterior glove shell 102. The back portion of exterior glove shell 102 is connected to palm-side portion 130 of exterior glove shell 102, and the remaining layers illustrated in FIG. 2 are attached between the back portion and palm-side portion 130.

Low-elasticity strengthening inserts can be affixed to the interior surface of palm-side portion 130 of exterior glove shell 102 in any number and location. In some examples, strengthening inserts span substantially the entire extent of palm-side portion 130. FIGS. 3-26 illustrate the interior surface of exemplary palm-side portions of an exterior glove shell having low-elasticity strengthening inserts affixed in a variety of exemplary configurations. The inserts in FIGS. 3-26 are denoted through shading. Additional configurations are also possible.

Figure 3:
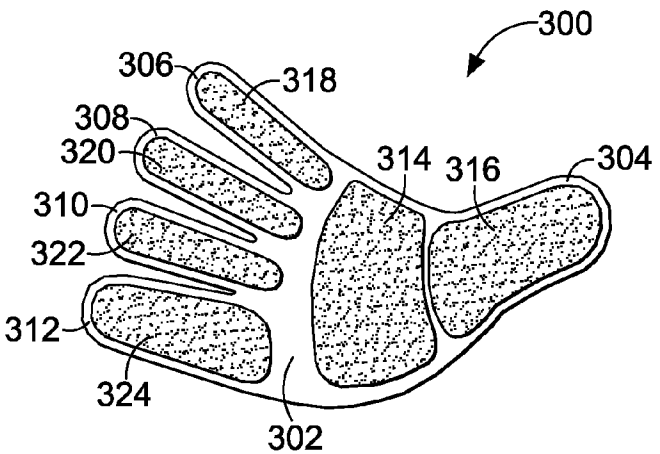
FIG. 3 is a perspective view of the interior surface of the palm-side portion of the exterior glove shell having six strengthening inserts affixed in an exemplary configuration.

FIG. 3 illustrates the interior surface of palm-side portion 300 of an exterior glove shell, including palm portion 302, thumb portion 304, and finger portions 306, 308, 310, and 312. Palm portion 302 has an extent approximately equal to the area of palm-side portion 300 corresponding to the palm of a user when the glove of which palm-side portion 300 is a part is worn. Thumb portion 304 and finger portions 306, 308, 310, and 312 each extend from palm portion 302. Low-elasticity strengthening inserts 314, 316, 318, 320, 322, and 324 are affixed to palm portion 302, thumb portion 304, and finger portions 306, 308, 310, and 312, respectively, of palm-side portion 300 to significantly reduce the amount palm-side portion 300 stretches. Inserts 316, 318, 320, 322, and 324 are substantially as long as the corresponding finger or thumb portions of palm-side portion 300.

Figure 4:
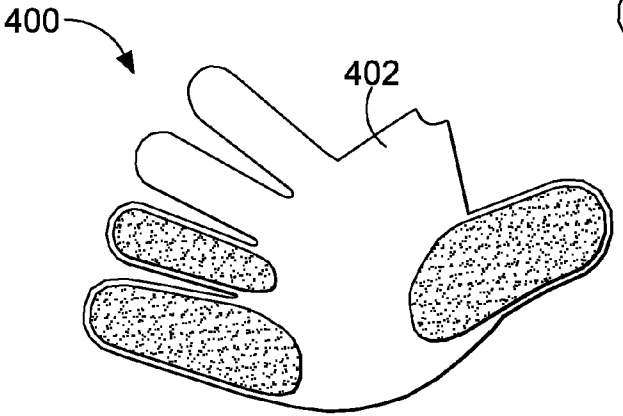
FIG. 4 is a perspective view of the interior surface of the palm-side portion of the exterior glove shell having strengthening inserts affixed in an additional exemplary configuration.
Figure 11:
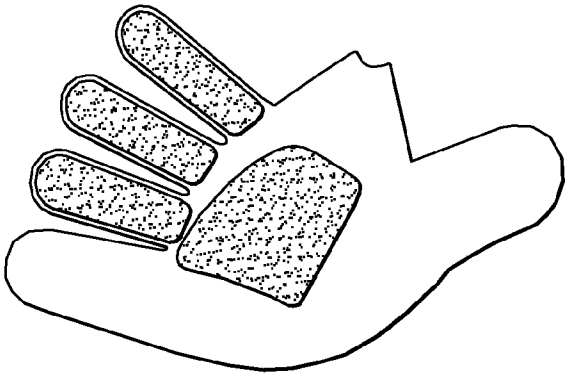
FIG. 11 is a perspective view of the interior surface of the palm-side portion of the exterior glove shell having strengthening inserts affixed in an additional exemplary configuration.

FIG. 4 illustrates the interior surface of palm-side portion 400 of an exterior glove shell. In contrast to palm-side portion 300 of FIG. 3, palm-side portion 400 includes a webbing portion 402.

FIGS. 5-26 illustrate various configurations of low-elasticity strengthening inserts affixed to the interior surface of palm-side portions. The palm-side portions are either shaped similarly to palm-side portion 300 in FIG. 3 or shaped similarly to palm-side portion 400 in FIG. 4, which has a webbing portion. The number, shape, and location of the inserts illustrated in FIGS. 5-26 is exemplary. Additional configurations are contemplated and are within the scope of the present invention.

Figure 6:
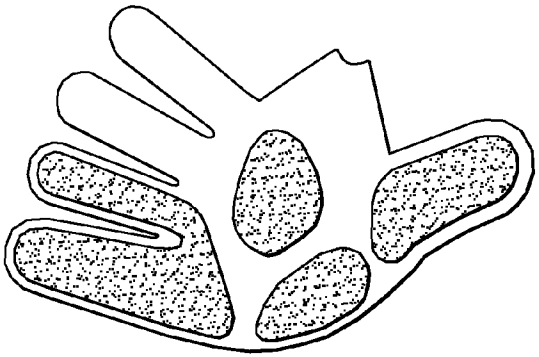
FIG. 6 is a perspective view of the interior surface of the palm-side portion of the exterior glove shell having strengthening inserts affixed in an additional exemplary configuration.
Figure 5:
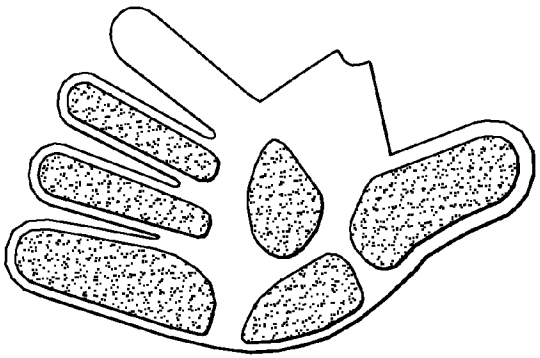
FIG. 5 is a perspective view of the interior surface of the palm-side portion of the exterior glove shell having strengthening inserts affixed in an additional exemplary configuration.
Figure 7:
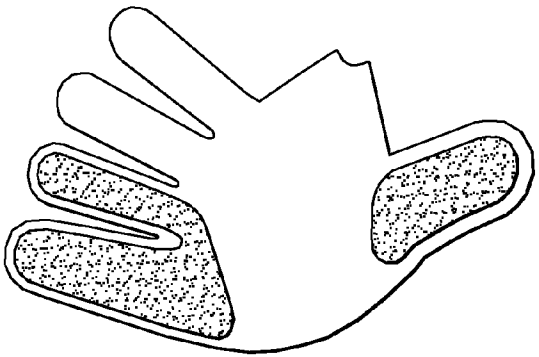
FIG. 7 is a perspective view of the interior surface of the palm-side portion of the exterior glove shell having strengthening inserts affixed in an additional exemplary configuration.
Figure 12:
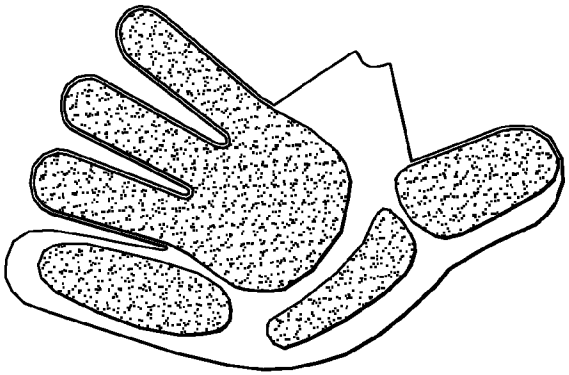
FIG. 12 is a perspective view of the interior surface of the palm-side portion of the exterior glove shell having strengthening inserts affixed in an additional exemplary configuration.
Figure 10:
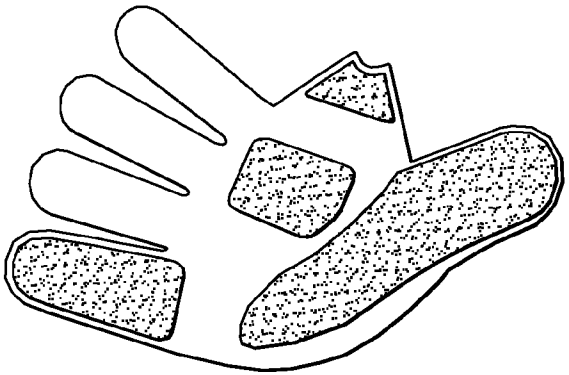
FIG. 10 is a perspective view of the interior surface of the palm-side portion of the exterior glove shell having strengthening inserts affixed in an additional exemplary configuration.
Figure 8:
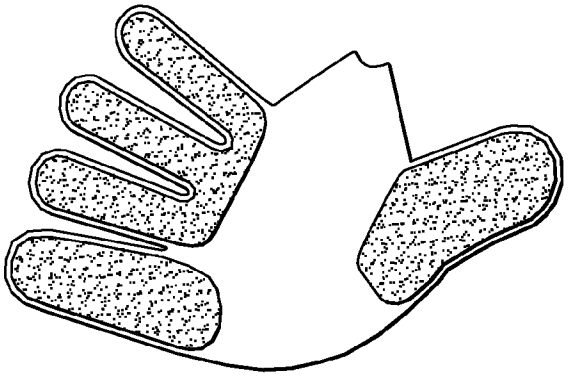
FIG. 8 is a perspective view of the interior surface of the palm-side portion of the exterior glove shell having strengthening inserts affixed in an additional exemplary configuration.
Figure 9:
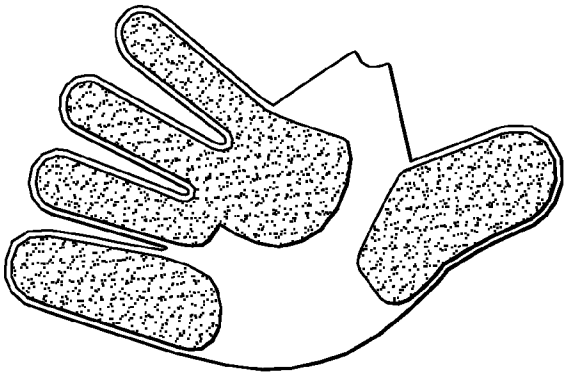
FIG. 9 is a perspective view of the interior surface of the palm-side portion of the exterior glove shell having strengthening inserts affixed in an additional exemplary configuration.
Figure 16:
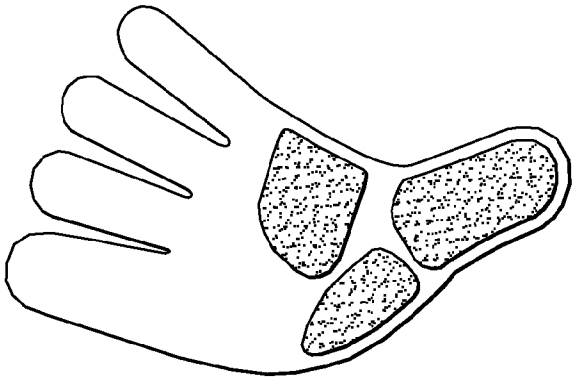
FIG. 16 is a perspective view of the interior surface of the palm-side portion of the exterior glove shell having strengthening inserts affixed in an additional exemplary configuration.
Figure 17:
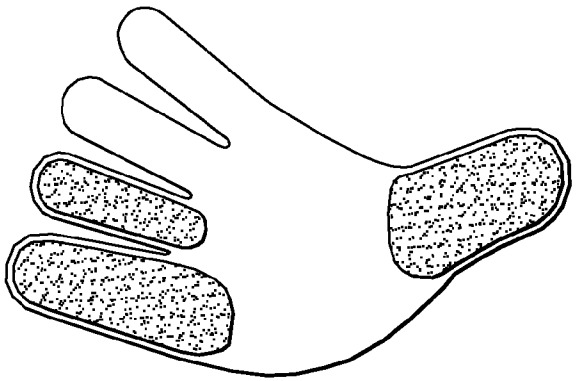
FIG. 17 is a perspective view of the interior surface of the palm-side portion of the exterior glove shell having strengthening inserts affixed in an additional exemplary configuration.
Figure 15:
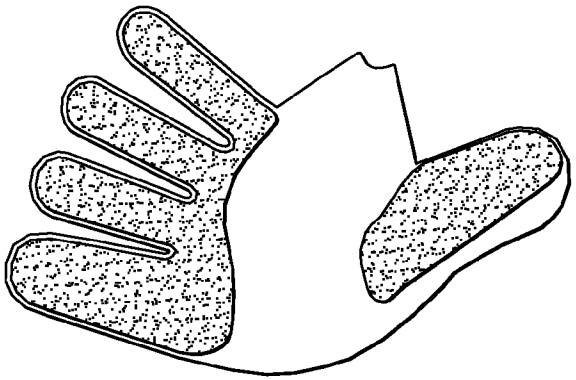
FIG. 15 is a perspective view of the interior surface of the palm-side portion of the exterior glove shell having strengthening inserts affixed in an additional exemplary configuration.
Figure 13:
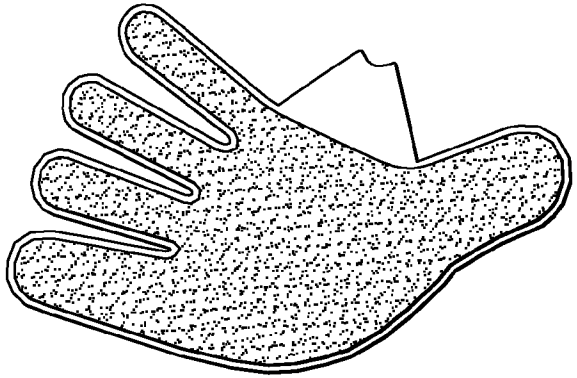
FIG. 13 is a perspective view of the interior surface of the palm-side portion of the exterior glove shell having strengthening inserts affixed in an additional exemplary configuration.
Figure 14:
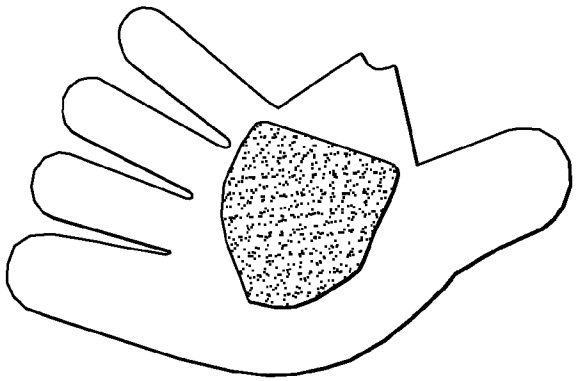
FIG. 14 is a perspective view of the interior surface of the palm-side portion of the exterior glove shell having strengthening inserts affixed in an additional exemplary configuration.
Figure 21:
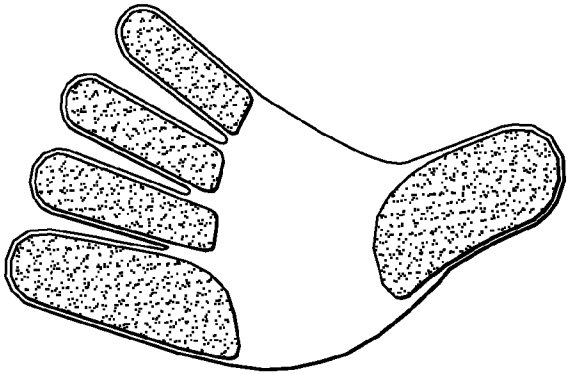
FIG. 21 is a perspective view of the interior surface of the palm-side portion of the exterior glove shell having strengthening inserts affixed in an additional exemplary configuration.
Figure 22:
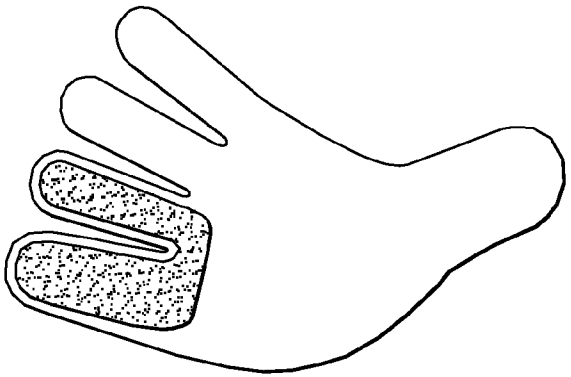
FIG. 22 is a perspective view of the interior surface of the palm-side portion of the exterior glove shell having strengthening inserts affixed in an additional exemplary configuration.
Figure 20:
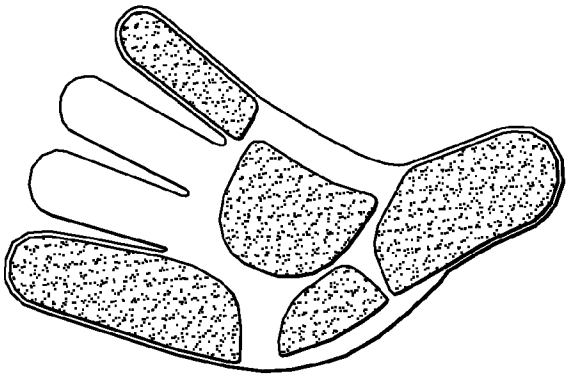
FIG. 20 is a perspective view of the interior surface of the palm-side portion of the exterior glove shell having strengthening inserts affixed in an additional exemplary configuration.
Figure 18:
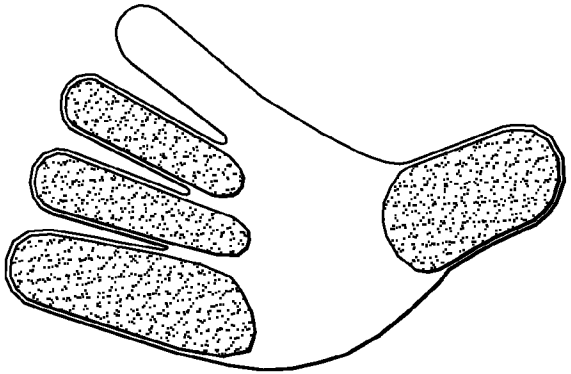
FIG. 18 is a perspective view of the interior surface of the palm-side portion of the exterior glove shell having strengthening inserts affixed in an additional exemplary configuration.
Figure 19:
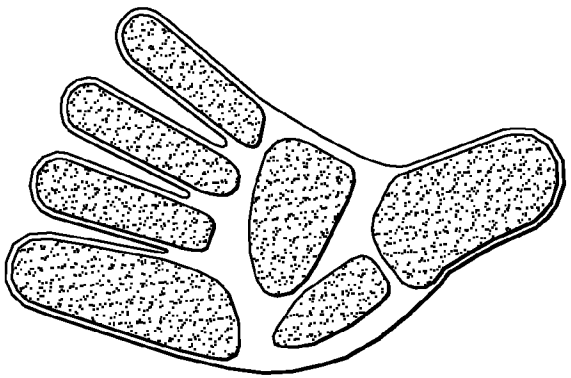
FIG. 19 is a perspective view of the interior surface of the palm-side portion of the exterior glove shell having strengthening inserts affixed in an additional exemplary configuration.
Figure 25:
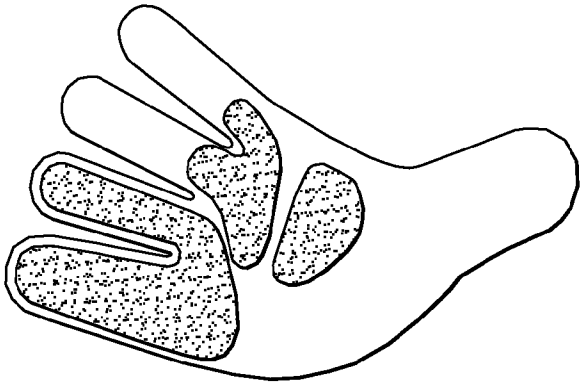
FIG. 25 is a perspective view of the interior surface of the palm-side portion of the exterior glove shell having strengthening inserts affixed in an additional exemplary configuration.
Figure 26:
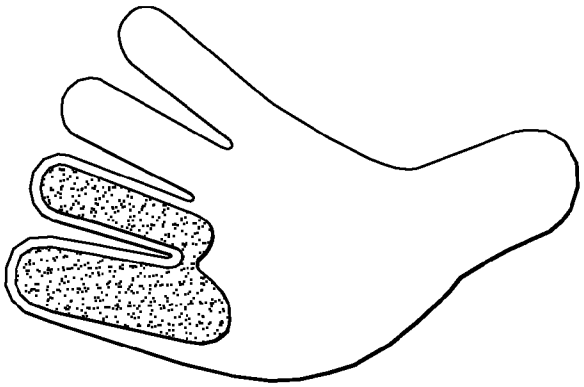
FIG. 26 is a perspective view of the interior surface of the palm-side portion of the exterior glove shell having strengthening inserts affixed in an additional exemplary configuration.
Figure 23:
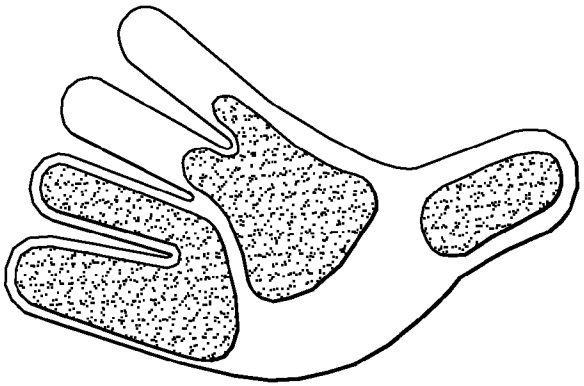
FIG. 23 is a perspective view of the interior surface of the palm-side portion of the exterior glove shell having strengthening inserts affixed in an additional exemplary configuration.
Figure 24:
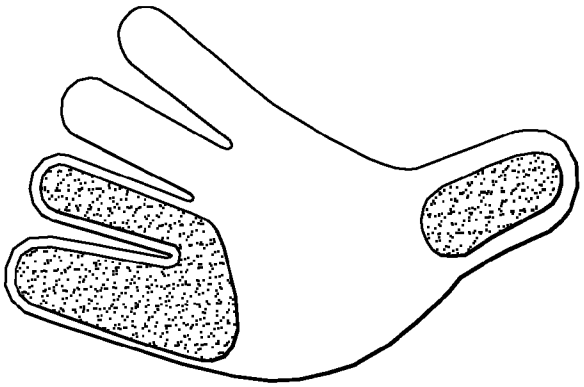
FIG. 24 is a perspective view of the interior surface of the palm-side portion of the exterior glove shell having strengthening inserts affixed in an additional exemplary configuration.

In some examples, such as the examples illustrated in FIGS. 5 and 6, multiple inserts are attached to the palm portion. When multiple inserts are attached to the palm portion, the inserts may be shaped and affixed to the palm portion in locations selected to maintain the integrity of the glove in the selected locations so that creasing of the glove in the selected locations is minimized. In other examples, such as FIGS. 9 and 12, an insert is partially affixed to the palm portion. In FIGS. 9 and 12, an insert that is one continuous piece of material is affixed to three finger portions, and the insert continues partially onto the palm portion of the middle layer. In FIG. 10, an insert is located on the webbing portion of the middle layer. In other examples not illustrated, inserts affixed to finger portions extend only part of the length of the finger portions. In further examples not shown, a strengthening insert has an extent substantially the same as the extent of the palm-side portion to which it is affixed. As discussed above, any number, shape, and location of low-elasticity strengthening inserts affixed to the interior surface of a palm-side portion of an exterior glove shell is contemplated. Also, at least one additional strengthening insert can be affixed to the interior surface of the palm-side portion to provide additional support to the palm portion, as described in conjunction with the examples of FIGS. 3-26.

Figure 27:
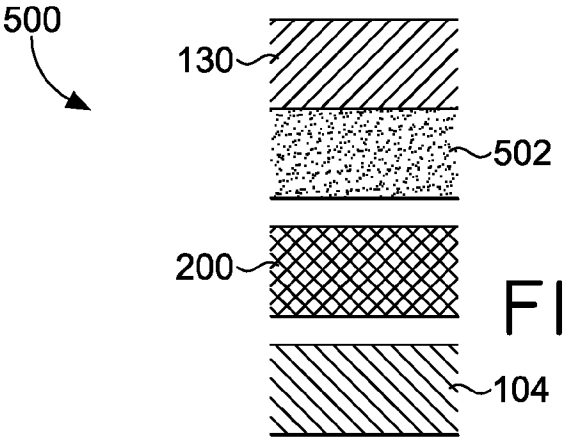
FIG. 27 is a side elevation view of a partial glove cross section illustrating the layers of a glove in accordance with an example of the present invention.

FIG. 27 illustrates a side elevation view of a partial glove cross section 500 illustrating the layers of glove 100 having a low-elasticity strengthening insert affixed to the interior surface of a palm-side portion of an exterior glove shell. Middle layer 200 is embedded between palm-side portion 130 of exterior glove shell 102 and interior glove liner 104. Low-elasticity strengthening insert 502 is affixed to the interior surface of palm-side portion 130. In FIG. 27, layers 130, 200, and 104 are shown with space between the layers. In some examples, layers 130, 200, and 104 are connected together. In other examples, middle layer 200 is omitted or additional middle layers are incorporated.

Figure 28:
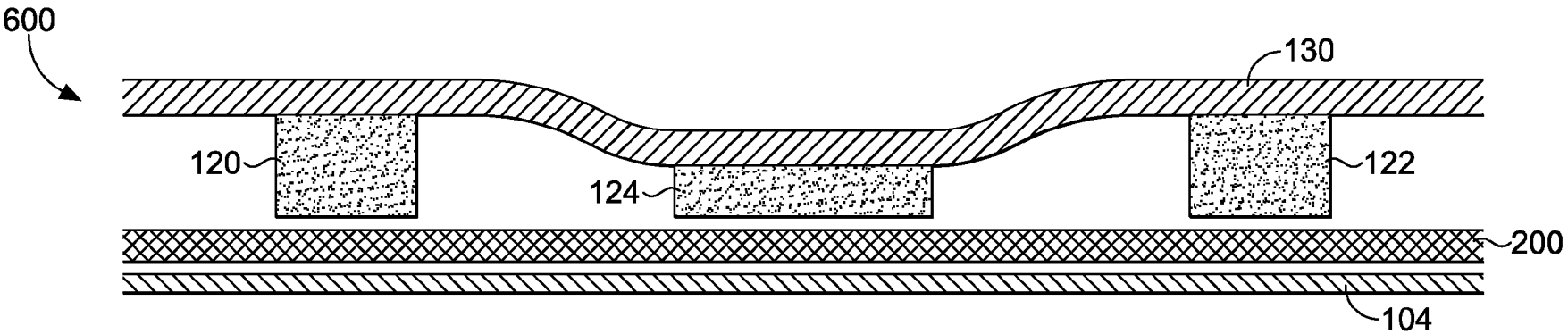
FIG. 28 is a side elevation view of a partial glove cross section illustrating the layers of a glove having three inserts in accordance with an example of the present invention.

FIG. 28 illustrates a side elevation view of a partial cross section 600 of glove 100 illustrating the layers and inserts comprising glove 100. Middle layer 200 is embedded between palm-side portion 130 of exterior glove shell 102 and interior glove liner 104. Low-elasticity strengthening inserts 120, 122, and 124 are affixed to the interior surface of palm-side portion 130. The thickness of strengthening insert 124, affixed to the palm portion of palm-side portion 130, is less than the thickness of inserts 120 and 122, affixed to the thumb and pinky finger portions of palm-side portion 130, respectively. Such a configuration allows the corresponding thumb and pinky finger sheaths to retain cushioning and rigidity to a slightly higher degree than the palm of the glove.

Figure 29:
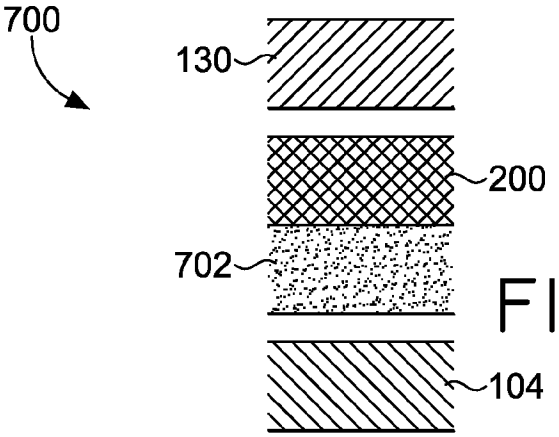
FIG. 29 is a side elevation view of a partial glove cross section illustrating the layers of a glove in accordance with an example of the present invention in which strengthening inserts are affixed to a middle layer.

FIG. 29 illustrates a side elevation view of a partial glove cross section 700 illustrating the layers of glove 100 having a low-elasticity strengthening insert 502 affixed to middle layer 200. In this example, insert 502 enhances the integrity of middle layer 200. Middle layer 200 is embedded between palm-side portion 130 of exterior glove shell 102 and interior glove liner 104. As discussed above, low-elasticity strengthening inserts have an elasticity lower than the elasticity of the material to which they are affixed. In FIG. 29, insert 502 therefore has an elasticity lower than the elasticity of middle layer 200.

Figure 30:
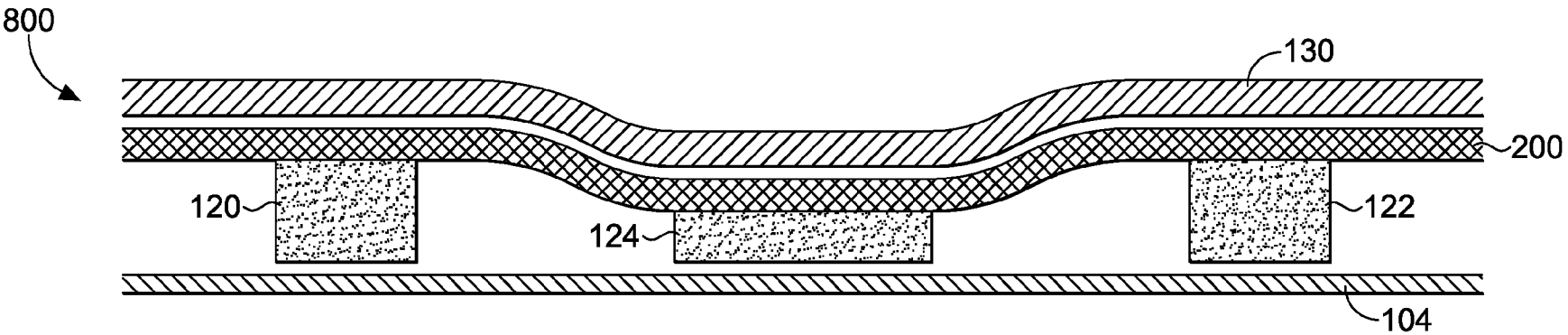
FIG. 30 is a side elevation view of a partial glove cross section illustrating the layers of a glove having three inserts in accordance with an example of the present invention in which strengthening inserts are affixed to a middle layer.

FIG. 30 illustrates a side elevation view of a partial cross section 800 of glove 100 illustrating the layers and inserts comprising glove 100. Middle layer 200 is embedded between exterior glove shell 102 and interior glove liner 104. Low-elasticity strengthening inserts 120, 122, and 124 are affixed to middle layer 200. The thickness of strengthening insert 124 is less than the thickness of inserts 120 and 122, embedded in the thumb sheath and pinky finger sheath, respectively. Such a configuration allows the corresponding thumb and pinky finger sheaths to retain cushioning and rigidity to a slightly higher degree than the palm of the glove.

The present invention encompasses baseball gloves, softball gloves, tee-ball gloves, and other gloves used to field or catch objects.

The present invention has been described in relation to particular examples, which are intended in all respects to be illustrative rather than restrictive. Alternative examples will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. An athletic glove configured to receive a human hand, the athletic glove comprising:

an exterior glove shell having a palm-side portion and a back portion, the palm-side portion having a palm portion, four finger portions and a thumb portion, the four finger portions and the thumb portion forming an index finger sheath, a middle finger sheath, a ring finger sheath, a pinky finger sheath, and a thumb sheath;

an interior glove liner substantially inside and connected to the exterior glove shell at least along an opening configured to receive a human hand, the opening located opposite the index finger sheath, the middle finger sheath, the ring finger sheath, and the pinky finger sheath;

a glove webbing connected to and extending between the thumb sheath and the index finger sheath;

a middle layer between the exterior glove shell and the interior glove liner; and a palm portion strengthening insert that is less elastic than the exterior glove shell affixed to an interior surface of the palm portion of the palm-side portion, a thumb sheath strengthening insert affixed to an interior surface of the palm-side of the thumb sheath and a pinky finger sheath strengthening insert affixed to an interior surface of the palm-side of the pinky finger sheath, wherein a thickness of the palm portion strengthening insert is less than a thickness of the thumb sheath strengthening insert and a thickness of the pinky finger sheath strengthening insert.

2. The athletic glove of claim 1, wherein the palm portion strengthening insert is made of a pliable, non-woven polyester material.

3. The athletic glove of claim 1, wherein the palm portion strengthening insert is affixed to the interior surface of the palm-side portion of the exterior glove shell using adhesive.

4. The athletic glove of claim 1, wherein the palm portion strengthening insert is shaped and affixed to the interior surface of the palm-side portion of the exterior glove shell at least in a location corresponding to the palm portion, selected to maintain the integrity of the glove so that creasing of the glove in the palm portion is minimized.

5. The athletic glove of claim 1, wherein the glove is one of a baseball glove or a softball glove.

6. The athletic glove of claim 1, wherein the glove is a mitt, and wherein the four finger portions of the palm-side portion of the exterior glove shell are connected together to form a continuous piece.

7. The athletic glove of claim 1, wherein an additional strengthening insert is affixed to at least one of the index finger sheath, the middle finger sheath, and the ring finger sheath.

8. The athletic glove of claim 1, further comprising at least one additional middle layer.

9. The athletic glove of claim 1, wherein the palm portion strengthening insert has an extent substantially the same as the extent of the palm-side portion of the exterior glove shell.

10. The athletic glove of claim 1, further comprising at least one additional strengthening insert affixed to the interior surface of the palm-side portion, wherein the at least one additional strengthening insert is affixed to the palm portion.

11. The athletic glove of claim 1, further comprising at least one additional strengthening insert affixed to the interior surface of the palm-side portion, and wherein the at least one additional strengthening insert is affixed to the thumb portion or a finger portion.

12. The athletic glove of claim 1, further comprising at least three additional strengthening inserts affixed to the interior surface of the palm-side portion, wherein one of the at least three additional strengthening inserts is affixed to the thumb portion and two of the at least three additional strengthening inserts are each affixed to one out of the four finger portions.

13. The athletic glove of claim 1, further comprising at least two additional strengthening inserts affixed to the interior surface of the palm-side portion, and wherein a first strengthening insert of the at least two additional strengthening inserts is affixed to the thumb portion and a second strengthening insert of the at least two additional strengthening inserts is affixed to one of the four finger portions.

14. An athletic glove capable of receiving a human hand, the athletic glove comprising:

an exterior glove shell having a palm-side portion corresponding to a palm side of a user's hand and a back portion corresponding to a back side of the user's hand, the palm-side portion having a palm portion, four finger portions, and a thumb portion;

an interior glove liner substantially inside and connected to the exterior glove shell to form index, middle, ring, and pinky finger sheaths, a thumb sheath, and an opening capable of receiving a human hand, the opening located opposite the four finger sheaths and corresponding approximately to the wrist of the user when the glove is worn by the user with fingers of the user extending within the four finger sheaths and the thumb of the user extending within the thumb sheath;

a glove webbing connected to and extending between the thumb sheath and the index finger sheath;

a middle layer comprising a pinky portion, a three finger portion, and a thumb portion layer between the exterior glove shell and the interior glove liner, the middle layer providing cushioning and rigidity to the glove; and at least two strengthening inserts that are less elastic than the exterior glove shell and are permeable to air and water, affixed at least in part to the interior surface of the palm portion of the palm-side portion of the exterior glove shell, a thumb strengthening insert affixed to an interior surface of the palm-side of the thumb sheath and a pinky finger strengthening insert affixed to the interior surface of the palm-side of the pinky finger sheath, the inserts maintaining the integrity of the exterior glove shell after repeated use of the glove by limiting the amount the exterior glove shell stretches, and minimizing creasing of the palm portion of the glove where the strengthening inserts are affixed, wherein a thickness of the strengthening insert affixed to the palm portion is less than a thickness of the inserts affixed to the interior surface of the palm-side of the thumb sheath and a thickness of the strengthening insert affixed to the interior surface of the palm-side of the pinky finger sheath.

15. The athletic glove of claim 14, wherein the at least two strengthening inserts are purposely affixed to the interior surface of the palm side portion, such that the glove creasing will be guided to a location other than where the strengthening inserts are affixed.

16. An athletic glove capable of receiving a human hand, the athletic glove comprising:

an exterior glove shell having a palm-side portion corresponding to a palm side of a user's hand and a back portion corresponding to a back side of the user's hand, the palm-side portion having a palm portion, four finger portions, and a thumb portion;

an interior glove liner substantially inside and connected to the exterior glove shell to form index, middle, ring, and pinky finger sheaths, a thumb sheath, and an opening capable of receiving a human hand, the opening located opposite the four finger sheaths and corresponding approximately to the wrist of the user when the glove is worn by the user with fingers of the user extending within the four finger sheaths and the thumb of the user extending within the thumb sheath;

a glove webbing connected to and extending between the thumb sheath and the index finger sheath;

a middle layer comprising a pinky portion, a three finger portion, and a thumb portion between the exterior glove shell and the interior glove liner, the middle layer providing cushioning and rigidity to the glove; and at least two strengthening inserts that are less elastic than the exterior glove shell affixed to the interior surface of the palm-side portion of the exterior glove shell, the inserts made of a pliable, non-woven polyester material that maintains the integrity of the exterior glove shell after repeated use of the glove by limiting the amount the exterior glove shell stretches, and wherein from the at least two strengthening inserts, at least one insert affixed to the thumb portion and at least one insert affixed to the palm portion or one finger portion of the four finger portions, wherein a thickness of a first strengthening insert of the at least two strengthening inserts is greater than a thickness of a second strengthening insert of the at least two strengthening inserts.

17. The athletic glove of claim 16, wherein the shape of the insert affixed to the thumb portion substantially corresponds to the shape of the thumb portion.

* * * * *